US009522457B2

(12) United States Patent
Huang

(10) Patent No.: US 9,522,457 B2
(45) Date of Patent: Dec. 20, 2016

(54) SLEEVE STRUCTURE FOR DAMAGED SCREW NUT

(71) Applicant: Shi-Yi Huang, Changhua (TW)

(72) Inventor: Shi-Yi Huang, Changhua (TW)

( * ) Notice: Subject to any disclaimer, the term of this patent is extended or adjusted under 35 U.S.C. 154(b) by 284 days.

(21) Appl. No.: 14/298,945

(22) Filed: Jun. 8, 2014

(65) Prior Publication Data

US 2015/0352695 A1 Dec. 10, 2015

(51) Int. Cl.
*B25B 13/06* (2006.01)
*B25B 27/18* (2006.01)
*B25B 23/10* (2006.01)

(52) U.S. Cl.
CPC ..... *B25B 13/065* (2013.01); *B25B 23/105* (2013.01); *B25B 27/18* (2013.01)

(58) Field of Classification Search
CPC ..... B25B 13/06; B25B 13/065; B25B 27/18
USPC ..... 81/124.6
See application file for complete search history.

(56) References Cited

U.S. PATENT DOCUMENTS 3,996,819 A * 12/1976 King ..... B25B 13/065 81/124.6
4,126,063 A * 11/1978 Palmer ..... B25B 13/065 81/124.6
4,361,412 A * 11/1982 Stolarczyk ..... F16B 23/0007 411/402
4,671,141 A * 6/1987 Hanson ..... B25B 13/065 81/441
5,832,792 A * 11/1998 Hsieh ..... B25B 27/18 81/121.1
6,536,309 B1 * 3/2003 Pool ..... B25B 27/18 81/120
6,668,686 B1 * 12/2003 Hsien ..... B25B 13/065 81/119
7,228,764 B1 * 6/2007 Macor ..... B25B 13/06 81/121.1
2005/0087043 A1 * 4/2005 Good ..... B25B 13/065 81/124.6
2007/0151425 A1 * 7/2007 Macor ..... B25B 13/065 81/121.1
2007/0289426 A1 * 12/2007 Chaconas ..... B25B 13/06 84/52
2008/0245195 A1 * 10/2008 Lee ..... B25B 13/065 81/124.6

* cited by examiner

*Primary Examiner* — David B Thomas
(74) *Attorney, Agent, or Firm* — Che-Yang Chen; Law offices of Scott Warmuth

(57) ABSTRACT

A sleeve may include a hexagonal engaging hole at one end that engages with the screw nut and a coupling hole at the other end that engages with a wrench; wherein the engaging hole is inwardly tapered and the taper angle is two to four degrees, thereby enabling easy engagement of the engaging hole with screw nut; and there is a dodge groove formed at each corner of the hexagonal engaging hole and each pair of adjacent dodge grooves are separated with a driving block; and the surface of each driving block that touches the screw nut is concave and thus a driving corner is formed on each side of the driving block; and each driving block has a groove and thus two adjacent interior corners are formed at the bottom of the groove.

4 Claims, 6 Drawing Sheets

SLEEVE STRUCTURE FOR DAMAGED SCREW NUT

FIELD OF THE INVENTION

This invention is related to a sleeve structure, and more particularly to a sleeve structure that does not damage the corners of a screw nut during operations and can be used to drive a screw with a damaged nut.

BACKGROUND OF THE INVENTION

Sleeves are often used to drive screws and are usually made of materials harder than those used to manufacture screws. When a sleeve is used to drive a screw, the size of the sleeve is usually larger than that of the screw nut to enable easy engagement of the sleeve with the screw nut, thereby leaving space between the sleeve and the screw nut. During operations, the space may cause the sleeve to slip and the driving force may be applied at the corners of the screw nut, thereby deteriorating the corners and making the screw difficult to drive. Sleeves that can be used to drive a screw with a damaged nut have been discussed in US20080245195, US20060117917 and US20070125204. However, the sleeves provided by US20060117917 and US20070125204 can only drive a screw in a single direction and cannot work effectively, because they can only grip the screw at two positions on each side of the screw nut and thus cannot apply the driving force properly. Therefore, there remains a need for a new and improved sleeve to overcome the problems stated above.

SUMMARY OF THE INVENTION

The conventional sleeves that can be used to drive a screw with a damaged screw nut can only drive a screw in a single direction and cannot work effectively, because they can only grip the screw at two positions on each side of the screw nut and thus cannot apply the driving force properly.

To overcome the problems stated above, the present invention provides a sleeve that may include a hexagonal engaging hole at one end that engages with the screw nut and a coupling hole at the other end that engages with a wrench. The engaging hole is inwardly tapered and the taper angle is two to four degrees, thereby enabling easy engagement of the engaging hole with the screw nut. There is a dodge groove formed at each corner of the hexagonal engaging hole and each pair of adjacent dodge grooves are separated with a driving block. The surface of each driving block that touches the screw nut is concave and thus a driving corner is formed on each side of the driving block. And each driving block has a groove and thus two adjacent interior corners are formed at the bottom of the groove.

Comparing with the conventional arts, the present invention has three advantages:

First, when the sleeve is rotated, two driving corners and two interior corners grip the screw at different positions on each side of the screw nut, while the corners of the screw nut do not touch the interior of the sleeve due to the dodge groove at each corner of the engaging hole, thereby preventing deterioration of the screw nut's corners.

Second, the sleeve can also be used to drive a screw with a damaged screw nut. When the sleeve is used to drive the screw with a damaged screw nut, two driving corners and two interior corners grip the screw at different positions on each side of the screw nut and therefore the screw can be driven despite the screw nut's deteriorated corners. Since the driving corners are formed on both sides of each driving block, the sleeve can be used to drive a screw clockwise or counter-clockwise.

Third, the addition of the interior corners increases the number of gripping positions on each side of the screw nut, thereby preventing the sleeve from slipping during operations and enabling proper application of the driving force.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
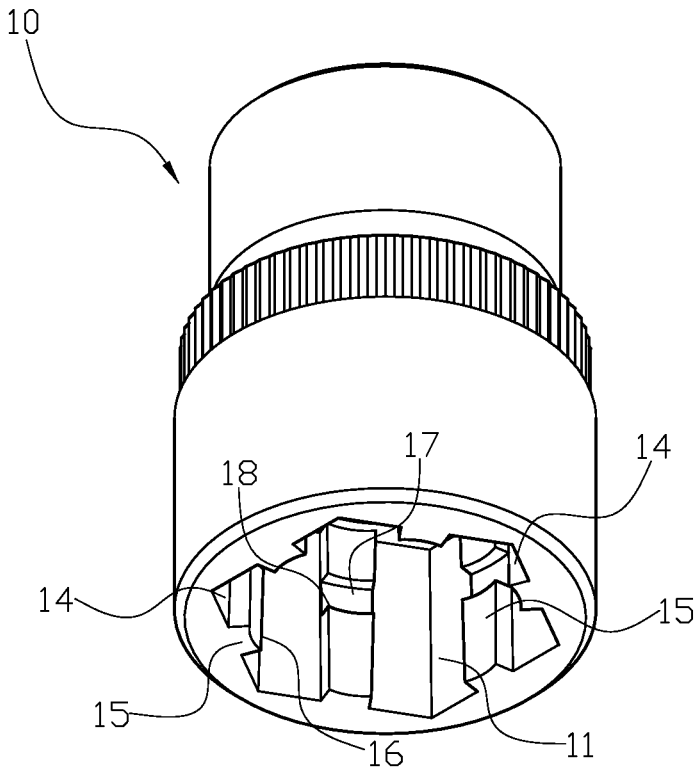
FIG. 1 illustrates a three-dimensional view of the present invention.
Figure 2:
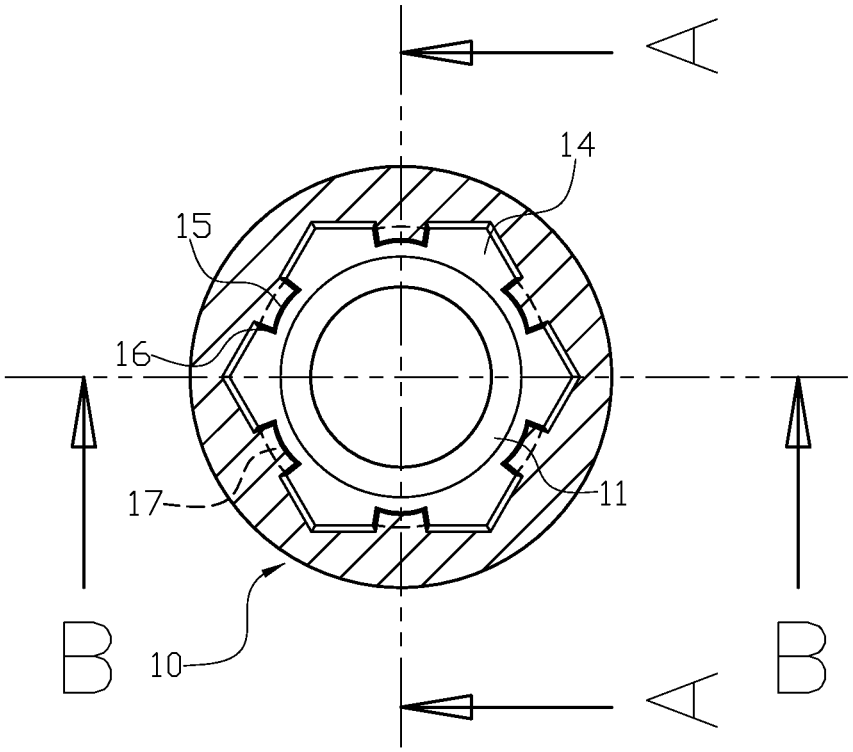
FIG. 2 illustrates a two-dimensional view of the present invention.
Figure 4:
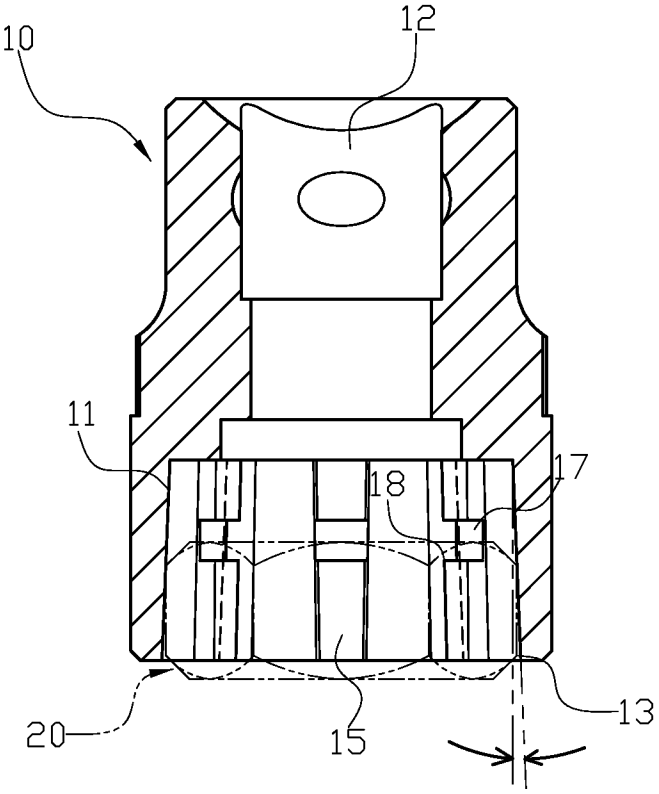
FIG. 4 illustrates a sectional view taken along the B-B line shown in FIG. 2.
Figure 3:
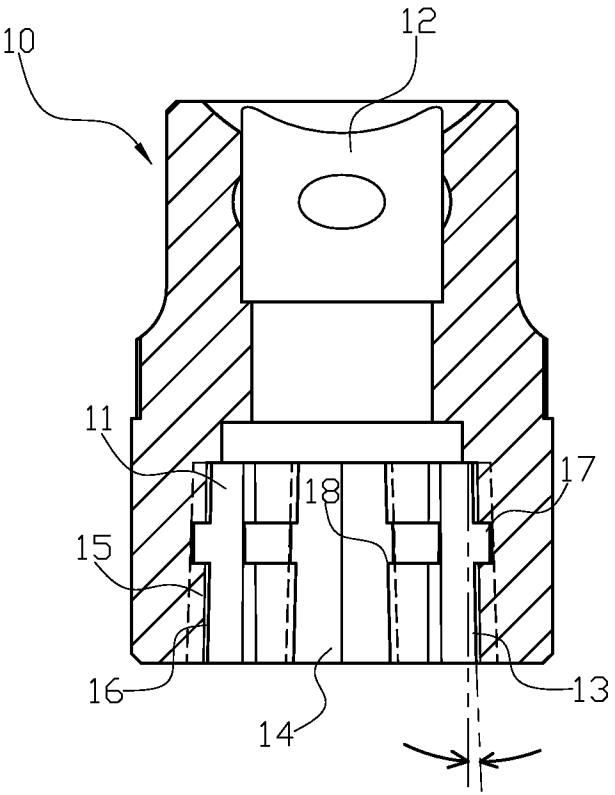
FIG. 3 illustrates a sectional view taken along the A-A line shown in FIG. 2.

In order to further understand the goal, characteristics and effect of the present invention, a number of embodiments along with the drawings are illustrated as following:

As shown in FIGS. 1 to 3, the sleeve (10) has a hexagonal engaging hole (11) at one end that engages with the screw nut (20) and a coupling hole (12) at the other end that engages with a wrench. The engaging hole (11) is inwardly tapered and the taper angle is two to four degrees, thereby enabling easy engagement of the engaging hole (10) with the screw nut (20). There is a dodge groove (14) formed at each corner of the hexagonal engaging hole (11) and each pair of adjacent dodge grooves are separated with a driving block (15). The surface of each driving block (15) that touches the screw nut is concave and thus a driving corner (16) is formed on each side of the driving block (15). And each driving block (15) has a groove (17) and thus two adjacent interior corners (18) are formed at the bottom of the groove (17).

When the sleeve (10) is used to drive a screw, the engaging hole (11) is engaged with the screw nut (20). The inwardly tapered shape of the engaging hole (11) enables easy engagement. The tilted interior walls (13) also enable close engagement of the engaging hole (11) with the screw nut (20), thereby preventing the sleeve from slipping and enabling the driving force to be focused in a certain proper area. When the sleeve (10) is rotated, two driving corners (16) and two interior corners (18) grip the screw at different positions on each side of the screw nut (20), while the corners of the screw nut (20) do not touch the interior of the sleeve (10) due to the dodge groove (14) at each corner of the engaging hole (11), thereby preventing deterioration of the screw nut's (20) corners.

Figure 6:
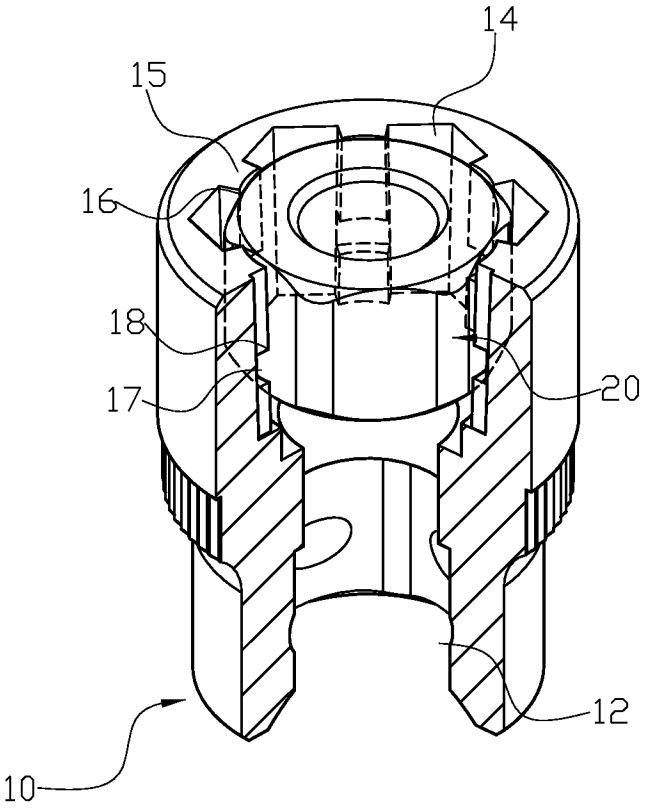
FIG. 6 illustrates a schematic three-dimensional view of the present invention when it is used to drive a screw with a damaged screw nut.
Figure 5:
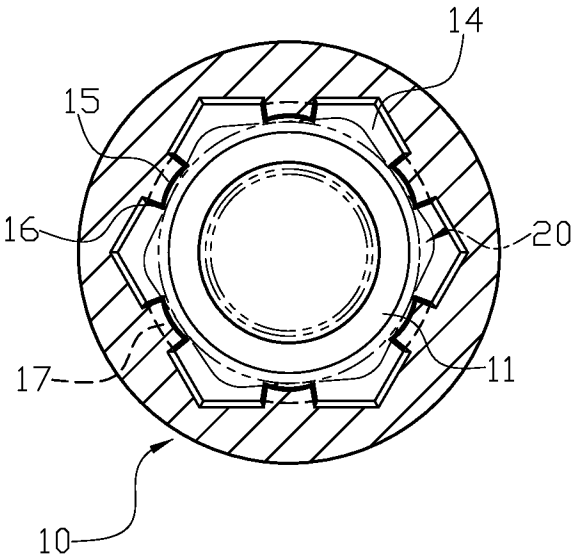
FIG. 5 illustrates a schematic sectional view of the present invention when it is used to drive a screw with a damaged screw nut.

As shown in FIGS. 5 and 6, the sleeve (10) can also be used to drive a screw with a damaged screw nut (20). When the sleeve (10) is used to drive a screw with a damaged screw nut (20), two driving corners (16) and two interior corners (18) grip the screw at different positions on each side of the screw nut (20) and therefore the screw can be driven despite the screw nut's deteriorated corners. Since the driving corners (16) are formed on both sides of each driving block (15), the sleeve can be used to drive a screw clockwise or counter-clockwise.

Figure 7:
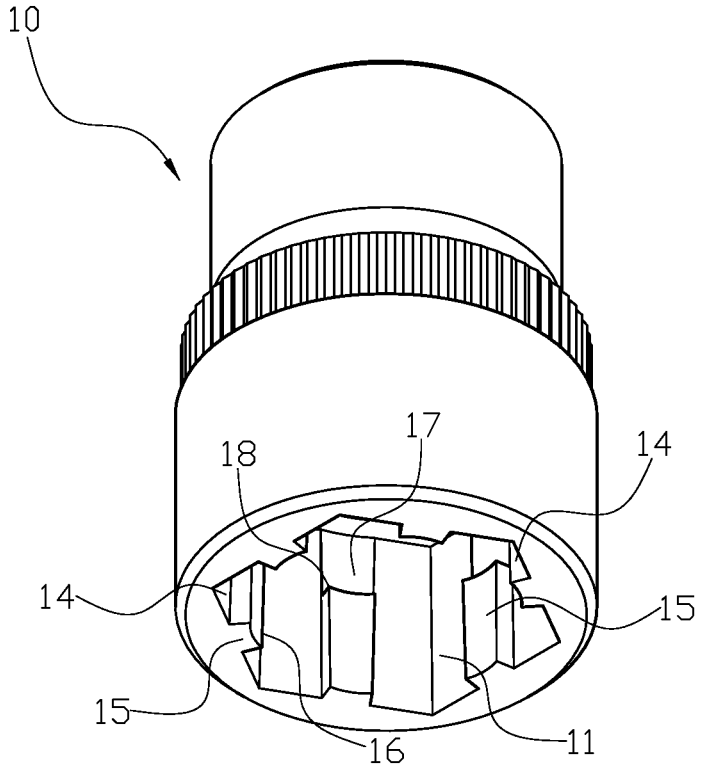
FIG. 7 illustrates a three-dimensional view of another embodiment in the present invention.
Figure 9:
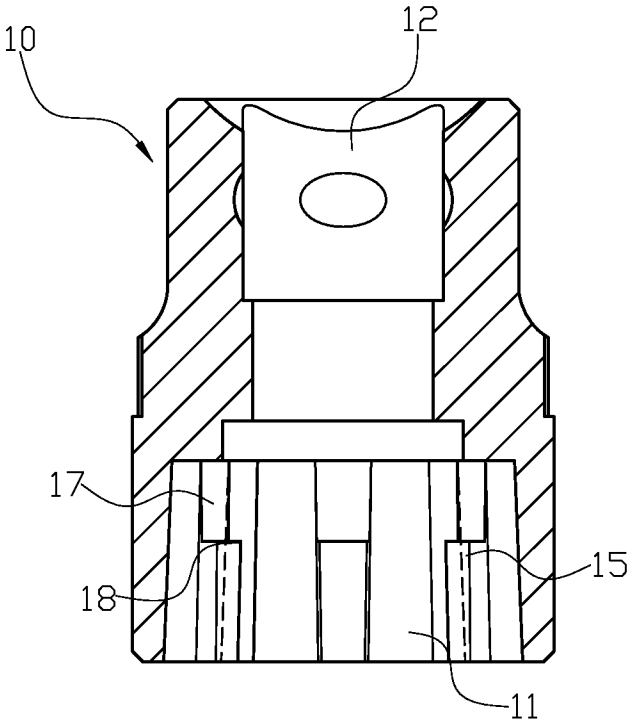
FIG. 9 illustrates another sectional view of the other embodiment in the present invention.
Figure 8:
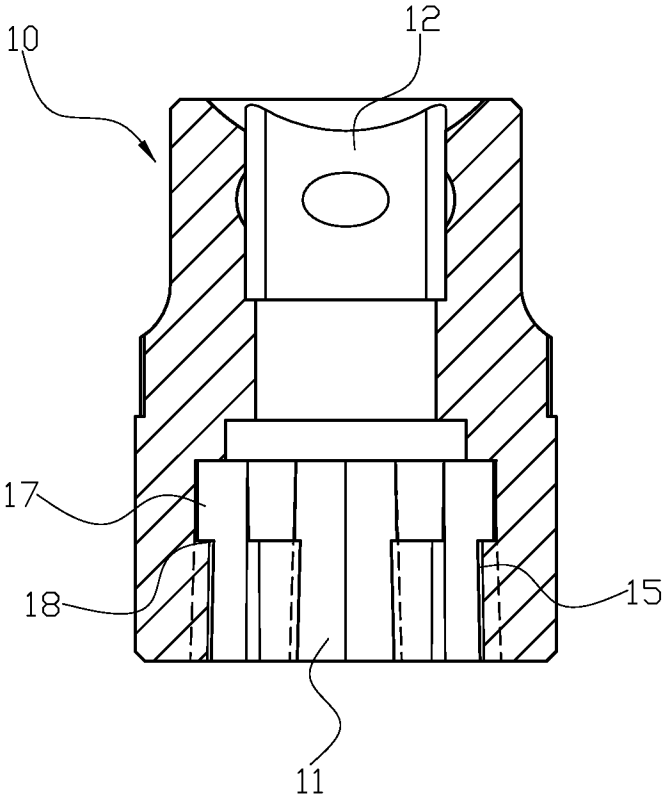
FIG. 8 illustrates a sectional view of the other embodiment in the present invention.

A groove (17) can be formed at the middle of each driving block (15) (as shown in FIGS. 1 to 6) or at each driving block's end that is near the bottom of the engaging hole (11) (as shown in FIGS. 7 to 9), and same effect can be achieved in either way.

According to the embodiments discussed above, the present invention has three advantages:

First, when the sleeve is rotated, two driving corners and two interior corners grip the screw at different positions on each side of the screw nut, while the corners of the screw nut do not touch the interior of the sleeve due to the dodge groove at each corner of the engaging hole, thereby preventing deterioration of the screw nut's corners.

Second, the sleeve can also be used to drive a screw with a damaged screw nut. When the sleeve is used to drive a screw with a damaged screw nut, two driving corners and two interior corners grip the screw at different positions on each side of the screw nut and therefore the screw can be driven despite the screw nut's deteriorated corners. Since the driving corners are formed on both sides of each driving block, the sleeve can be used to drive a screw clockwise or counter-clockwise.

Third, the addition of the interior corners increases the number of gripping positions on each side of the screw nut, thereby preventing the sleeve from slipping during operations and enabling proper application of the driving force.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A sleeve comprising a hexagonal engaging hole at one end that engages with a screw nut and a coupling hole at the other end that engages with a wrench, wherein the engaging hole is inwardly tapered, thereby enabling easy engagement of the engaging hole with the screw nut; and a dodge groove is formed at each corner of the hexagonal engaging hole and each pair of adjacent dodge grooves are separated with a driving block; and the surface of each driving block that touches the screw nut is concave and thus a driving corner is formed on each side of the driving block; and each driving block has a groove and thus two adjacent interior corners are formed at a bottom of the groove, when the sleeve is rotated, two driving corners and two interior corners grip the screw nut at different positions on each side of the screw nut, while the corners of the screw nut do not touch the interior of the sleeve due to the dodge groove at each corner of the engaging hole.

2. The sleeve of claim 1, wherein the engaging hole is inwardly tapered for two to four degrees.

3. The sleeve of claim 1, wherein the groove is formed at a middle section of each driving block.

4. The sleeve of claim 1, wherein the groove is formed at a rear end of the engaging hole corresponding to each driving block.

* * * * *